US005100440A

United States Patent [19]

Stahel et al.

[11] Patent Number: 5,100,440

[45] Date of Patent: Mar. 31, 1992

[54] EMISSION ELECTRODE IN AN ELECTROSTATIC DUST SEPARATOR

[75] Inventors: Walter Stahel, Obfelden; Werner Diener, Esslingen, both of Switzerland

[73] Assignee: Elex AG, Zurich, Switzerland

[21] Appl. No.: 641,177

[22] Filed: Jan. 15, 1991

[30] Foreign Application Priority Data

Jan. 17, 1990 [CH] Switzerland ..... 00152/90

[51] Int. Cl.[5] ..... B03C 3/00

[52] U.S. Cl. ..... 55/152; 361/230; 29/825; 29/DIG. 95

[58] Field of Search ..... 55/150–153; 361/230; 29/825, DIG. 95

[56] References Cited

U.S. PATENT DOCUMENTS

| | | | |
|---|---|---|---|
| 3,158,454 | 11/1964 | Gustafsson | 55/152 |
| 4,303,418 | 12/1981 | Coe | 55/152 |
| 4,666,475 | 5/1987 | Gustavsson | 55/152 |
| 4,673,417 | 6/1987 | Gorganusson et al. | 55/152 |
| 4,848,986 | 7/1989 | Leluschko et al. | 55/152 |

FOREIGN PATENT DOCUMENTS

| | | | |
|---|---|---|---|
| 1575405 | 9/1980 | United Kingdom | 55/152 |

*Primary Examiner*—Bernard Nozick

*Attorney, Agent, or Firm*—Bachman & LaPointe

[57] ABSTRACT

The emission electrode (12) has a support section (16), which imparts mechanical strength, with emission tips (20) disposed in at least two rows and directed on both sides towards adjacent collecting electrodes. It is composed of a single-piece metal sheet symmetrically folded to form the support section (16) which metal sheet has emission arms (18) which are integrally formed outside the folded support section (16) and extend over its entire active length (1) along the central plane (E) between the collecting electrodes (10) and which have emission tips (20) extending in the plane (E) or directed on both sides towards the adjacent collecting electrodes. The metal sheet is bent through more than a right angle on the inside of the emission arms (18) to form a double loop. To produce the emission electrode (12) a metal sheet having integrally formed emission arms (18) slotted at the front apices (19) is punched out "in-line" and cold-worked in the longitudinal direction to form the folded support section (16) on the inside of the emission arms (18). The emission tips are bent in the same operation.

13 Claims, 3 Drawing Sheets

EMISSION ELECTRODE IN AN ELECTROSTATIC DUST SEPARATOR

BACKGROUND OF THE INVENTION

The invention relates to a self-supporting emission electrode in an electrostatic dust separator having laminar collecting electrodes which guide the gas flow, which emission electrode, extending parallel to the collecting electrodes and suspended on a supporting lug, comprises a single-piece metal sheet symmetrically folded to form a support section, which imparts mechanical strength, and has emission arms, disposed in at least two rows and extending along the central plane between the collecting electrodes, which have emission tips extending in the plane of the emission arms or directed on both sides towards the adjacent collecting electrodes. Furthermore, the invention relates to a method of producing the emission electrode.

In an electrostatic dust separator, termed an electrostatic filter for short, the gas to be purified is passed through many parallel channels of a housing. The channels are formed by a plurality of collecting electrodes which are arranged in rows behind one another and which may reach linear dimensions of 15 m and over. Disposed centrally and longitudinally between the collecting electrodes are the emission electrodes.

Whereas the collecting electrodes of a dust separator are, as a rule, earthed, the emission electrodes are at a high negative direct voltage which may be in the region of 100 kV. An electric force field is produced between the two electrodes. The electric force concentration at the emission electrode has to be great enough to produce a glow or corona discharge, which manifests itself as an intense, bluish glow. The emerging electrons ionize the air and other gases forming the atmosphere. The negative and positive ions produced during the ionization migrate to the electrodes of opposite polarity.

The migrating ions collide for their part with dust particles suspended in the gas flow, adhere to them and consequently impart an electric charge to them. Under the action of the electric field, the charged dust particles are attracted by the electrodes of opposite polarity. The overwhelming majority of the dust particles are negatively charged and they deposit at the positive collecting electrode. Only 1–3% of the dust particles are positively charged and deposit at the emission electrode having negative potential.

The dust particles do not all, however, give up their charge immediately to the electrode concerned and form, also as a consequence of adhesion and cohesion, loosely coherent layers of solid material.

When the dust layer has reached a thickness of 1–2 cm, it has to be detached from the electrode. This periodic cleaning is carried out in dry filters by tapping or shaking devices, and in wet filters by washing devices. In practice, tapping is carried out, for example, 1–8 times per hour.

For the efficiency of electrostatic filters, the amount of gas flowing through, the physical nature of the carrier gas, its humidity and temperature, the electric resistance and the behavior of the dust in the electric field are of importance. Finally, the particle composition and chemical analysis of the dust, the characteristics of the operative electric field, the gas velocity, the whirling up again of the dust on tapping, the gas composition, and the current and the voltage concomitantly determine the migration velocity of the electrically charged particles.

EP-A2 0,287,137 describes two variants of emission electrodes made of sheet-metal strips of continuously identical width.

According to a first variant, the emission electrode is shaped to form an approximately elliptical tubular cross section, with overlapping longitudinal edges which are joined to one another. Individually bent out of the tubular cross section are approximately triangular lugs. The lugs form on either side of the elliptical tubular cross section, in line with its main axis, outwardly pointing vanes with alternatingly bent emission tips.

According to a second variant, instead of an elliptical tubular cross section, two wide edge strips are bent of a narrow central strip at an angle in opposite directions. The longitudinal edges of the edge strips are flanged over in the same direction as the respective angling in a manner such that an essentially stretched Z-shaped cross section is produced. Approximately triangular lugs which are not situated on the central plane between the two parallel limbs are individually bent out of the edge strips, as in the first variant.

This embodiment of an emission electrode has, in relation to the configuration, the disadvantage that the bent lugs are restricted to a length which is below the major axis of the ellipse or the width of an edge strip. Furthermore, the production appears to be comparatively complex.

Furthermore, British Patent Specification 1,575,404 discloses an emission electrode for electrostatic separation which comprises a long, suspended support section and shoulder-forming elements, joined to the support section, for forming a corona. The support section comprises a metal strip and has a stiffener extending centrally in the longitudinal direction. The longitudinally central stiffener has open parts of channel-shaped design on either side, for example in the form of a longitudinally extending corrugated fold. This embodiment has the disadvantage that it is not capable of imparting the stiffness of a conventional tubular support section. Furthermore, only single-piece embodiments which have emission tips forming sawtooth-like shoulders which are disposed near the support section are shown. Since they are disposed in the region of the support section, the emission tips of a plurality of emission electrodes are not ideally distributed. Since the metal sheets cannot be of an arbitrarily wide construction, a two-part embodiment of the emission electrode having emission arms individually attached to a parent body is formed to achieve a better distribution of the emission tips (FIGS. 7 and 8).

SUMMARY OF THE INVENTION

The object of the present invention is to provide an emission electrode which is a single piece apart from suspension and linking elements and which is capable of imparting at least the stiffness of a conventional tubular support section, does not have any geometrical limits for an ideal configuration and can be manufactured both simply and in a material-saving way.

In relation to the device, the object is achieved, according to the invention, in that the metal sheet has symmetrically shoulder-forming emission arms punched out on both longitudinal sides and is bent through more than a right angle out of the plane of the emission arms inside the emission arms to form a region essentially folded continuously in the form of a double loop. Specific embodiments and further developments are discussed below.

Since only relatively low currents flow at very high voltage in electrostatic filters, the electrical conductivity of the material used to produce the emission electrodes is not of first importance. However, the support section which is composed exclusively of the folded metal sheet should have a mechanical strength comparable to a support section tube. The requirements relating to electrical conductivity, mechanical strength and machinability are fulfilled on folding, in particular, strip steel, brass and high-strength aluminum alloys in accordance with the invention.

The mechanical strength and the production precision of the folded support section are of essential importance, and the emission electrodes must neither be caused to oscillate too vigorously by the gas flow nor be of unequal construction as a result of imprecise machining. In the event of twists or imprecise configuration, electrical arcs may be produced which result in a voltage collapse. Owing to its simplicity, the emission electrode according to the invention readily makes the necessary production precision possible.

Compared with the known embodiments, the double loops, in particular double triangles, according to the invention present more external mass, and this results in a higher moment of inertia. The simpler production is the result of folding with one axis of symmetry and a quasisymmetrical axis. The production of the fold is, however, not only simpler, but also more precise, and this has a particularly advantageous effect for the ideal position of the emission tips.

Furthermore, the suspended carrier has to withstand the periodic tapping without damage even in the long term.

To form the double loop, the metal sheet is bent out of the plane of the emission arms, preferably through more than 100°, in particular through more than 120°.

The length of the emission arms extending vertically with respect to the support section is preferably greater than the extension of the folded support section in that direction. In practice, the length of the emission arms is more than double the extension of the folded support section.

Not only the folded support section of the emission electrode is of symmetrical design, but also the emission arms and, according to the commonest embodiment variant, emission tips. The folded support section may, however, be in the region of one quarter to three quarters, based on the spacing, projected on a plane perpendicular to the longitudinal axis, between two adjacent emission tips. The entire emission electrode is, however, so designed that unequally long emission arms are disposed alternatingly on each side of the folded support section in order that no curves can arise in the longitudinal direction.

In industrial plants, electrostatic filters may reach an active height of 15 m and over. In that case, an emission electrode is made up of two preferably equally long sectional emission electrodes, two connecting lugs attached to the folded support section being screwed together. The connecting lugs may be used at the same time to provide connecting struts which extend parallel to the collecting electrodes in the horizontal direction and which prevent or at least severely restrict any oscillation of the suspended, very long emission electrodes.

In relation to the method of producing an emission electrode, the object is achieved, according to the invention, in that emission arms which are integrally formed from the metal sheet and slotted at the front apex are punched out "in-line" and cold-worked to form the folded support section in the longitudinal direction on the inside of the emission arms, and the emission tips are forced apart in the same operation.

As a result of the cold working, expediently a rolling method, the materials used are preferentially stiffened. As a result of this the mechanical strength of the folded support section is increased to a desirable extent.

It is furthermore of essential importance that the deformation takes place at a distance inside the emission arms, which increases the stability, on the one hand, and facilitates the deformation process, on the other hand, because every emission arm does not have to be bent individually.

The outermost ends of the slotted emission arms are forced apart to form the emission tips in the same operation, that is to say "in-line", as the punching and rolling.

BRIEF DESCRIPTION OF THE DRAWINGS

The invention is explained in more detail with reference to exemplary embodiments which are shown in the drawings. In the drawings.

DETAILED DESCRIPTION

Figure 1:
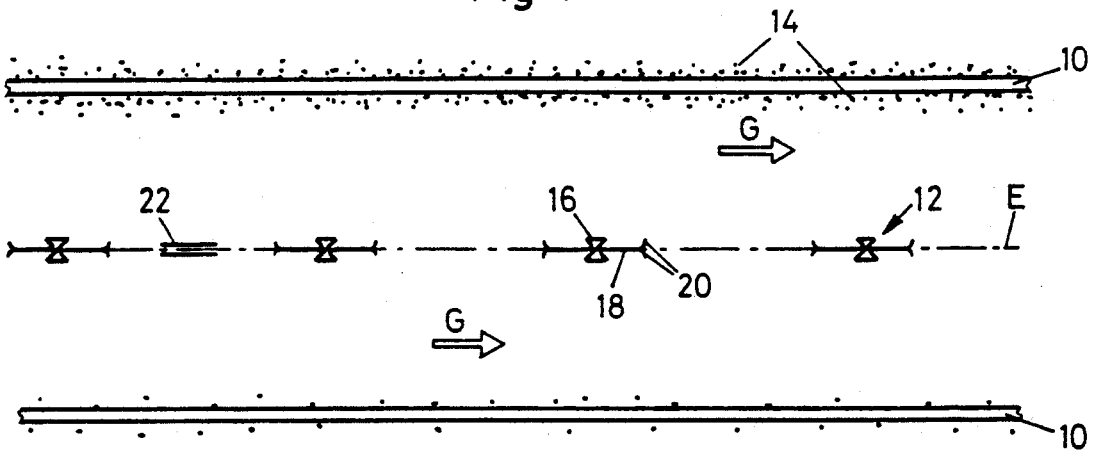
FIG. 1 shows a partial plan view of an open electrostatic filter.

The partial plan view, shown in FIG. 1, of an electrostatic filter shows two laminar collecting electrodes 10 extending in parallel and suspended emission electrodes 12 disposed in the central plane E. The emission electrodes 12 are suspended at regular intervals.

The gas flow G guided through the collecting electrodes 10 flows in the direction of the arrows and, depending the design of the electrostatic filter, also upwards or downwards, which is not visibly shown.

An approximately 1.5 cm thick dust layer 14 has accumulated on both sides of the upper collecting electrode 10 shown in FIG. 1. The lower collecting electrode 10 is virtually dust-free and has just been tapped. Approximately 97–99% of the entire amount of dust accumulates at the collecting electrodes.

The emission electrodes 12 essentially comprise a folded support section 16 and emission arms 18 extending on both sides parallel to the collecting electrodes 10 and each having two terminal emission tips 20 bent in opposite directions. The latter may also be situated in the plane of the emission arms 18.

A connecting strut 22 is indicated between two emission electrodes 12. This connecting strut 22 connects all the emission electrodes 12 at the height of the connecting lugs (FIGS. 8–10) expediently at half height, in the direction of the collecting electrodes 10.

Figure 3:
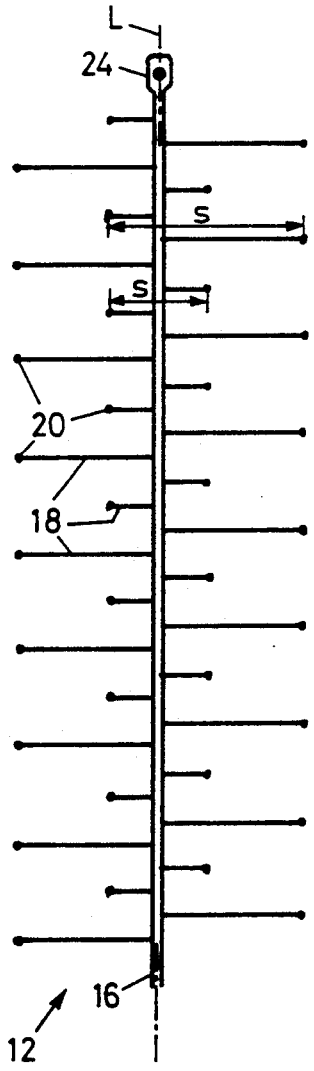
FIG. 3 shows a variant of FIG. 2, with unequally long emission arms.
Figure 2:
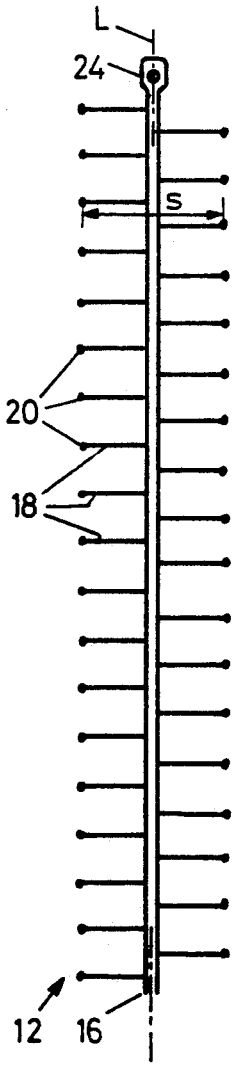
FIG. 2 shows a basic diagram of an emission electrode having equally long emission arms.

FIGS. 2 and 3 each show the upper part of a suspended emission electrode 12 which shows the principle of the arrangement of the emission arms 18. In both examples, the emission arms 18 are disposed on both sides of the folded support section 16.

In FIG. 2, the emission arms 18 on both sides are equally long and the emission tips 20 form two vertical rows with a spacing of s/2.

According to the embodiment of FIG. 3, alternatingly long and short emission arms 18 are arranged on each side. The emission tips 20 having a spacing s in relation to the projection on a plane perpendicular to the longitudinal direction L of the support section 16 therefore lie in four vertical rows. According to the embodiment of FIG. 3, the emission tips 20 are more uniformly distributed over a larger area.

The gas flow G flows essentially in the direction of the arrow, that is to say in the direction of the emission arms 18, rising and/or descending components not being shown.

The emission electrodes 12 are suspended on a supporting lug 24.

Figure 4:
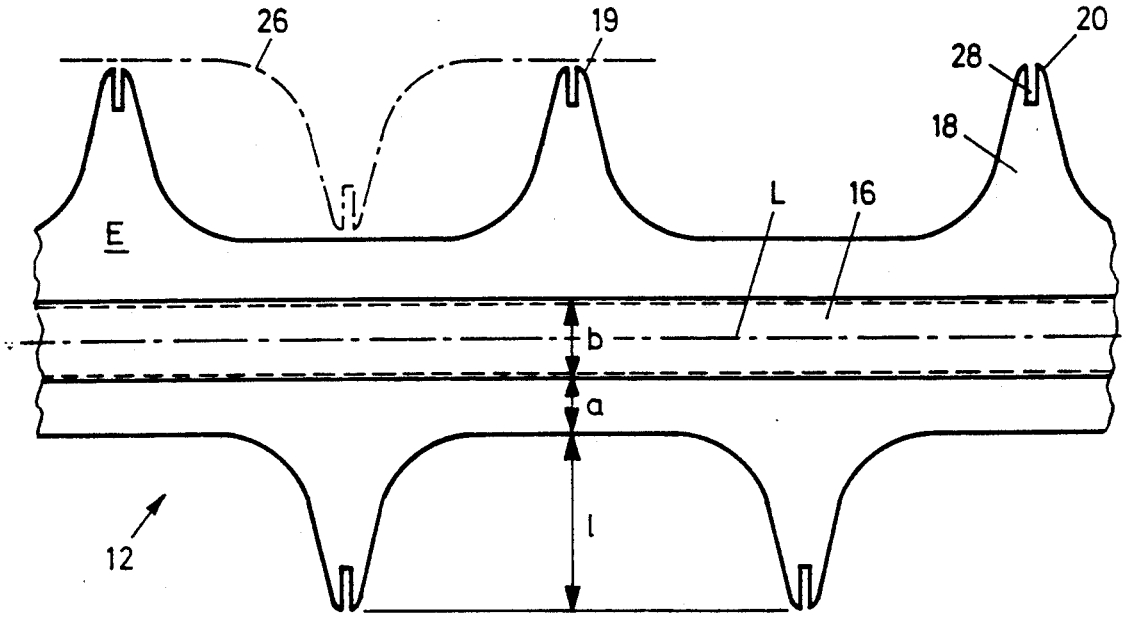
FIG. 4 shows an elevation of an emission electrode.

FIG. 4 shows a plan view of a previously punched-out metal sheet folded to form an emission electrode and having emission arms 18.

A broken line 26 shows the position of a further punched-out metal sheet which makes possible minimization of the waste.

Punched out of the front apex 19 of the integrally formed emission arms 18 is a slot 28 which makes it possible to force the emission tips 20 apart by machine.

The length 1 of the emission arms 18 is somewhat more than twice the width b of the folded support section in the same direction. The base of the emission arms 18 is at a distance a outside the fold. This emission base is never bent, and this simplifies in a decisive manner a manufacture by machine.

Figure 5:
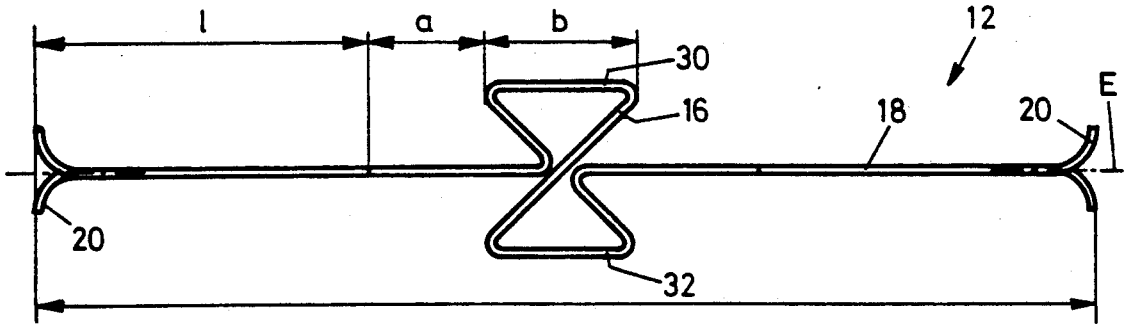
FIG. 5 shows a plan view of an emission electrode, without support section lug.

FIG. 5 shows an enlarged side elevation of FIG. 4. The metal sheet forming the support section 16 is bent six times through 135° to form two right-angled triangles with right angles situated on the plane E. The base 30, 32 of the triangles which are right-angled in cross section, which base has a width b, runs parallel to the plane E. The metal sheet bent three times passes through the plane E at an angle of 45° between the first and the last bend. The folded support section 16 acquires mechanical strength as a result of the cold working.

The emission arms 18 are situated on the plane E which, in the installed emission electrode 12, is the central plane between the collecting electrodes 10, but also between the base surfaces 30, 32. The emission tips 20 are forced apart and they are situated at a distance 1 from the metal plate not punched out and at a distance of 1+a from the vertical projection of the support section 16.

Figure 6:
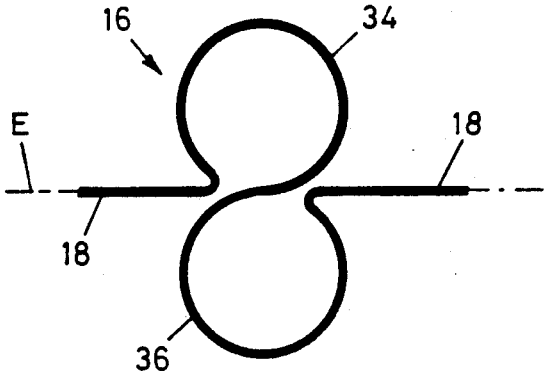
FIG. 6 shows a variant of a folded support section of an emission electrode according to FIG. 5.

FIG. 6 shows a fold which is essentially formed as a figure eight and which merges into the emission arms 18. The latter again lie on a plane, which is at the same time the tangential plane of the two folds shown as loops 34, 36 in the cross section. In the case of the installed emission electrode 12, the tangential plane coincides with the central plane E mentioned above.

Figure 7:
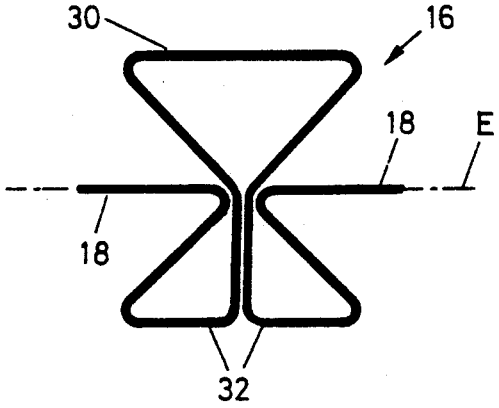
FIG. 7 shows a further variant of a folded support section of an emission electrode according to FIG. 5.

Finally, FIG. 7 shows a particularly preferred variant of the present invention. The metal sheet is first bent twice in opposite directions through 135° to produce the folded region 16. Then the metal sheet is bent through 90°, and consequently extends vertical to the plane E. On intersecting this plane, the sheet is bent outwards through 45° and then it is bent twice running in the same direction through 135°, but running in the opposite direction to the bend through 45° mentioned and forms the upper base surface 30.

The bent sheet now extends at an angle of 45° with respect to the plane E. At the line of intersection of the two planes, the metal sheet is bent outwards through 45°, as a result of which it extends vertically with respect to the plane E. At the level of the baseline 32 of the lower right-angled triangle formed, the metal sheet is bent through 90° and now extends in the plane of the base surface 32 of the lower right-angled triangle. Finally, the metal sheet is bent twice through 135° running in opposite directions, the second time in a manner such the metal sheet again lies in the plane E.

In this case again, a double loop is essentially formed, each loop being formed as an essentially right-angled triangle. The loops are designed in the form of right-angled triangles, with the apex in the region of the plane E.

Compared with FIG. 5, FIG. 7 has a disadvantage of less simple production to form the fold in a base surface, for example 32. This is offset, however, by the advantage of a substantial reinforcement of the torsional strength.

Figure 8:
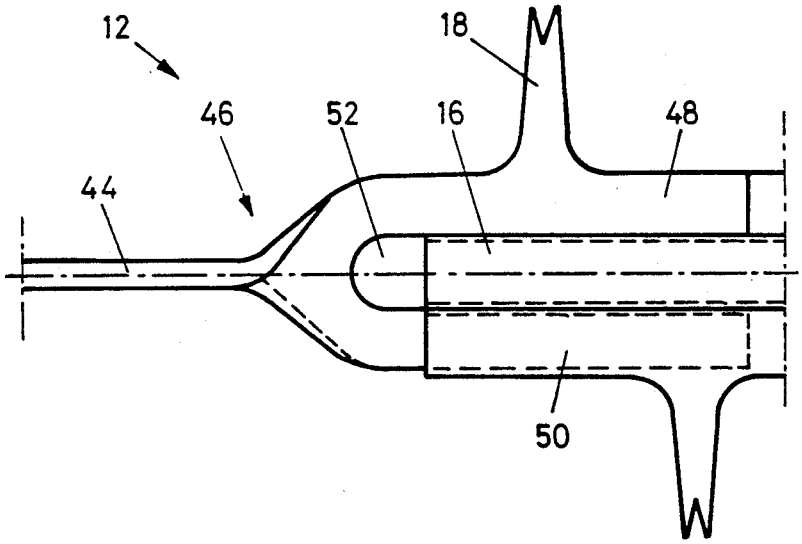
FIG. 8 shows an elevation of a connecting lug attached to an emission electrode.
Figure 9:
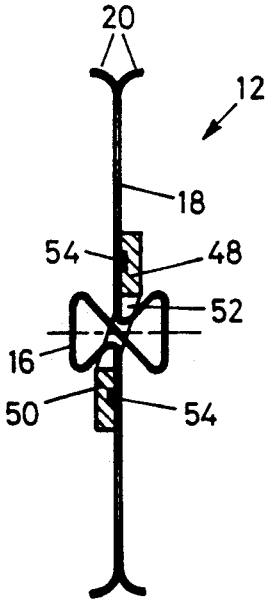
FIG. 9 shows a sectioned side elevation of FIG. 8, from the right.
Figure 10:
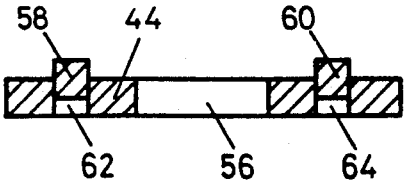
FIG. 10 shows a detailed partial section through a connecting lug of the left side of FIG. 8.

FIGS. 8 and 9 show the principle of providing a connecting lug 44 at the end face 46 of an emission electrode 12 as shown in FIG. 5.

The two prongs 48, 50 of the connecting lug 44 are offset with respect to each other, as emerges from FIG. 9. A support section 16 folded in a double loop is introduced into a longitudinal slot 52 between the prongs 48, 50. The prongs 48, 50 are connected to the metal sheet of the emission electrode 12 by means of a spot weld 54 outside the fold region.

The connecting lug 44 having a plane rotated through 90° is formed in a planar manner on the side facing away from the prongs 48, 50. This part of the connecting lug 44, which is shown in greater detail in FIG. 10, has a screw hole 56 and, at an equal distance on the longitudinal axis of the connecting lug, one round projection 58, 60 in each case. Cut out below each of the shoulder-forming projections 58, 60 is a blind hole 62, 64 which has the same diameter as the projections 58, 60.

Since all the connecting lugs 44 are of identical design, two emission electrodes can be very easily screwed to each other in a straight direction by introducing the projections 58, 60 into the blind holes 62, 64.

We claim:

1. In an electrostatic dust separator having an emission electrode and laminar collecting electrodes which guide the gas flow, the improvement which comprises: a self-supporting emission electrode having emission arms and extending parallel to the collecting electrodes; a supporting lug suspending said emission electrode; a single-piece metal sheet symmetrically folded to form a support section with a central plane (E) which imparts mechanical strength, said metal sheet having longitudinal sides and being bent through more than a right angle out of the central plane (E) to form a region essentially continuously folded in the form of a double loop as said support section on the inside of the emission arms; said emission arms comprising symmetrical shoulder forming emission arms punched out on the longitudinal sides of the metal sheet and disposed in at least two rows and extending along the central plane (E) on both sides of the metal sheet between and towards the adjacent collecting electrodes; and emission tips of said emission arms extending in the plane of the emission arms.

2. Article according to claim 1 wherein the double loop extends essentially in the form of a figure eight, with the emission arms on the tangential plane between the two loops.

3. Article according to claim 1 wherein the metal sheet is bent out of the plane (E) through more than 100° to form said double loop.

4. Article according to claim 3 wherein the metal sheet is bent through more than 120°.

5. Article according to claim 1 wherein said support section has a width (b) and wherein the length (l) of the emission arms extending vertically with respect to the support section and in the same direction as the width (b) is at least equal to the width.

6. Article according to claim 5 wherein the length of the emission arms is more than double the width.

7. Article according to claim 1 wherein the emission tips are spaced from each other a spacing (s) projected perpendicular to the longitudinal direction (L) of the folded support section, and wherein the folded support section is situated at from one quarter to three quarters of said distance (s) between two adjacent emission tips.

8. Article according to claim 7 wherein the folded support section is situated in the center of two adjacent emission tips.

9. Article according to claim 1 wherein the double loop of the support section is disposed essentially as a double triangle, with tips of the triangle situated in the central plane (E) and the base surfaces of the triangle extending parallel to the central plane (E).

10. Article according to claim 9 wherein the metal sheet is bent six times through 135° to form two right-angled triangles with right angles situated on the plane (E), and wherein the bent metal sheet passes through the plane (E) between two bends out of the plane (E).

11. Article according to claim 10 wherein the metal sheet is bent twice through 135°, then through 90° on passing at right angles through the plane (E), is then bent twice through 135°, on passing through the plane (E) again is bent through 45°, then through 90°, and finally is bent yet again through 135°.

12. Method of producing an emission electrode for an electrostatic dust separator having laminar collecting electrodes which guide the gas flow, which comprises: providing a self-supporting emission electrode having emission arms and extending parallel to the collecting electrodes; symmetrically folding a single-piece metal sheet to form a support section with a central plane which imparts mechanical strength, said metal sheet having longitudinal sides, wherein the metal sheet is bent through more than a right angle out of the central plane to form a region essentially continuously folded in the form of a double loop as said support section on the inside of the emission arms; integrally forming emission arms from the metal sheet, wherein the emission arms are slotted at the front apices and punched out in-line and cold-worked in the longitudinal direction to form the folded support inside the emission arms; and forcing apart emission tips extending in the plane of the emission arms in the same operation as the integrally forming step.

13. Method according to calim 12 wherein the cold working is carried out by means of rolling.

* * * * *

UNITED STATES PATENT AND TRADEMARK OFFICE

CERTIFICATE OF CORRECTION

PATENT NO. : 5,100,440

DATED : March 31, 1992

INVENTOR(S) : WALTER STAHEL ET AL.

It is certified that error appears in the above-identified patent and that said Letters Patent is hereby corrected as shown below:

In Column 8, line 9, after "$90^{o}$," --is bent through $45^{o}$-- should be inserted.

Signed and Sealed this

Twenty-first Day of June, 1994

*Attest:*

Bruce Lehman

BRUCE LEHMAN

*Attesting Officer*

*Commissioner of Patents and Trademarks*